US012745883B2

(12) United States Patent
Kim et al.

(10) Patent No.: US 12,745,883 B2
(45) Date of Patent: Sep. 29, 2026

(54) DUST COLLECTION BIN AND CLEANING APPARATUS COMPRISING SAME

(71) Applicant: Samsung Electronics Co., Ltd., Suwon-si (KR)

(72) Inventors: Seehyun Kim, Suwon-si (KR); Kihwan Kwon, Suwon-si (KR); Hyeoncheol Kim, Suwon-si (KR); Junho Park, Suwon-si (KR); Geunho Lee, Suwon-si (KR); Junghyun Lee, Suwon-si (KR); Hyunju Lee, Suwon-si (KR); Seungryong Cha, Suwon-si (KR); Ingyu Choi, Suwon-si (KR); Junggyun Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 621 days.

(21) Appl. No.: 18/155,469

(22) Filed: Jan. 17, 2023

(65) Prior Publication Data

US 2023/0148813 A1 May 18, 2023

Related U.S. Application Data

(63) Continuation of application No. PCT/KR2021/008474, filed on Jul. 5, 2021.

(30) Foreign Application Priority Data

Sep. 1, 2020 (KR) ..... 10-2020-0110917

(51) Int. Cl.
*A47L 9/16* (2006.01)
*A47L 9/10* (2006.01)
(Continued)

(52) U.S. Cl.
CPC ..... *A47L 9/1683* (2013.01); *A47L 9/106* (2013.01); *A47L 9/1691* (2013.01); *A47L 9/2873* (2013.01); *A47L 9/322* (2013.01)

(58) Field of Classification Search
CPC ..... A47L 9/1683; A47L 9/2873; A47L 9/322; A47L 9/106; A47L 9/1608; A47L 9/1641;
(Continued)

(56) References Cited

U.S. PATENT DOCUMENTS 6,192,550 B1 * 2/2001 Hamada ..... A47L 9/108 55/299
6,289,553 B1 9/2001 Dyson
(Continued)

FOREIGN PATENT DOCUMENTS

JP 3198745 B2 8/2001
KR 10-2001-0024752 A 3/2001
(Continued)

OTHER PUBLICATIONS

Korean Office Action dated Apr. 14, 2026, issued in Korean Application No. 10-2020-0110917.

*Primary Examiner* — Michael A Gump
(74) *Attorney, Agent, or Firm* — Jefferson IP Law, LLP

(57) ABSTRACT

The disclosure relates to a dust collection bin and a cleaning apparatus comprising same, and more specifically, to a dust collection bin with an improved structure, and to a cleaning apparatus comprising same. The dust collection bin is separably coupled to the cleaning apparatus, wherein the dust collection bin is provided so as to accommodate dust and foreign materials drawn therein and comprises an opening, a case comprising a magnet provided so as to generate a magnetic force around the opening, a cover provided to open and close the opening, and a sealing member provided on the cover so as to seal between the cover and the case, and
(Continued)

having magnetic properties so as to be deformable by the magnet.

17 Claims, 12 Drawing Sheets

(51) Int. Cl.
*A47L 9/28* (2006.01)
*A47L 9/32* (2006.01)

(58) Field of Classification Search
CPC ..... A47L 9/1691; A47L 9/16; A47L 9/1454; A47L 9/1445; A47L 9/1436; A47L 5/26; A47L 5/24; A47L 7/0042; A47L 15/4263
USPC ..... 15/347
See application file for complete search history.

(56) References Cited

U.S. PATENT DOCUMENTS

| | | | |
|---|---|---|---|
| 7,921,506 | B2 | 4/2011 | Baek et al. |
| 8,607,409 | B2 | 12/2013 | Han |
| 9,848,748 | B2 | 12/2017 | Stickney et al. |
| 10,390,670 | B2 | 8/2019 | Robinson et al. |
| 10,779,696 | B2 | 9/2020 | Cho |
| 11,406,236 | B2 | 8/2022 | Tanaka et al. |
| 2004/0148914 | A1 | 8/2004 | Lim et al. |
| 2008/0115813 | A1* | 5/2008 | Cosgrove ..... A47L 15/4263 134/56 D |
| 2008/0178418 | A1 | 7/2008 | Conrad |
| 2011/0006652 | A1 | 1/2011 | Veltrop |
| 2017/0356551 | A1* | 12/2017 | Ishizaki ..... F16J 15/43 |
| 2018/0084963 | A1* | 3/2018 | Lim ..... A47L 9/106 |
| 2020/0107685 | A1* | 4/2020 | Tanaka ..... A47L 9/108 |
| 2020/0359868 | A1* | 11/2020 | Bo ..... A47L 9/1683 |
| 2021/0139668 | A1* | 5/2021 | Schuette ..... C09D 7/62 |

FOREIGN PATENT DOCUMENTS

| | | | | |
|---|---|---|---|---|
| KR | 10-0409127 | B1 | | 12/2003 |
| KR | 10-0485717 | B1 | | 4/2005 |
| KR | 10-0593088 | B1 | | 6/2006 |
| KR | 20070015711 | A | * | 2/2007 |
| KR | 10-2012-0082532 | A | | 7/2012 |
| KR | 20120082532 | A | * | 7/2012 ..... B65D 43/0222 |
| KR | 10-1214669 | B1 | | 12/2012 |
| KR | 10-1223478 | B1 | | 1/2013 |
| KR | 10-1247532 | B1 | | 3/2013 |
| KR | 10-2014-0098847 | A | | 8/2014 |
| KR | 10-2016-0018319 | A | | 2/2016 |
| KR | 20160018319 | A | * | 2/2016 |
| KR | 10-1600317 | B1 | | 3/2016 |
| KR | 10-2018-0102604 | A | | 9/2018 |
| KR | 10-2019-0123794 | A | | 11/2019 |

* cited by examiner

DUST COLLECTION BIN AND CLEANING APPARATUS COMPRISING SAME

CROSS-REFERENCE TO RELATED APPLICATION(S)

This application is a continuation application, claiming priority under § 365(c), of an International application No. PCT/KR2021/008474, filed on Jul. 5, 2021, which is based on and claims the benefit of a Korean patent application number 10-2020-0110917, filed on Sep. 1, 2020, in the Korean Intellectual Property Office, the disclosure of which is incorporated by reference herein in its entirety.

BACKGROUND

1. Field

The disclosure relates to a dust collection bin and a cleaning apparatus including the same. More particularly, the disclosure relates to a dust collection bin with an improved structure and a cleaning apparatus including the same.

2. Description of Related Art

In general, a vacuum cleaner is an appliance that performs cleaning by including a fan motor for generating a suction force to suck foreign materials such as dust together with air through the suction force generated by the fan motor, separate the foreign materials included in the sucked air from the air and then collect the foreign materials.

The vacuum cleaner includes a dust collection bin for collecting foreign materials, and a user needs to periodically remove foreign materials collected in the dust collection bin from the vacuum cleaner by discharging the foreign materials from the dust collection bin.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a dust collection bin with an improved structure and a cleaning apparatus including the same.

Another aspect of the disclosure is to provide a dust collection bin having a gasket with functionality, and a cleaning apparatus including the same.

Another aspect of the disclosure is to provide a dust collection bin capable of performing locking and sealing with a gasket having magnetism, and a cleaning apparatus including the same.

Another aspect of the disclosure is to provide a dust collection bin capable of performing automatic opening/closing with a gasket having magnetism, and a cleaning apparatus including the same.

Additional aspects will be set forth in part in the description which follows and, in part, will be apparent from the description, or may be learned by practice of the presented embodiments.

In accordance with an aspect of the disclosure, a dust collection bin detachably coupled to a cleaning apparatus is provided. The dust collection bin includes a case configured to accommodate dust or a foreign material sucked therein, the case including an opening, and a magnet provided around the opening and configured to generate a magnetic force, a cover configured to open or close the opening, and a sealing member provided on the cover, configured to seal between the cover and the case, and being magnetic to be deformable by the magnet.

Also, the magnet may be positioned at a location corresponding to the sealing member such that the sealing member applies a sealing force to the case in a closed state of the cover.

Also, the sealing member includes a first material (rubber) which is at least one of nitrile-butadiene rubber (NBR), silicon rubber, thermoplastic polyurethane (TPU), or triethyl phosphate (TEP).

Also, the sealing member includes a second material obtained by mixing the first material with iron or steel powder of a size of 1 μm to 100 μm by 10 weight percent (wt %) to 80 wt %.

Also, the sealing member includes a first sealing portion configured to cover the opening, and a second sealing portion extending from the first sealing portion and being in contact with an inner wall of the case.

Also, the second sealing portion includes a free end that is deformable in shape by the magnet.

Also, at least one part of the second sealing portion may be formed as a curved surface.

Also, at least one portion of the free end may be formed as a curved surface.

Also, the magnet may be positioned in a lower end of the case to generate an attraction force with respect to the sealing member.

Also, the dust collection bin may further include a rotation device configured to rotate the cover with respect to a main body, and the rotation device includes a rotation shaft, and a torsion spring coupled to the rotation shaft, wherein one end of the torsion spring is connected with the cover and the other end of the torsion spring is connected with the case.

Also, the case may further include a locking device configured to lock or unlock the cover.

The locking device may further include a locking member configured to fix the cover to the case and release locking of the cover by being pressed by an external force.

Also, the case includes a magnet installing portion provided around the opening and configured to install the magnet.

Also, upon returning of the cover from an open state by the rotation device, the first sealing portion of the sealing member may cover the opening, and the second sealing portion may be deformed in shape to contact an inner wall of the case and seal the case.

In accordance with another aspect of the disclosure, a cleaning apparatus is provided. The cleaning apparatus includes a cleaner body including a suction portion configured to suck dust, and a dust collection bin detachably installed in the cleaner body and configured to separate dust from air sucked through the suction portion and store the dust, wherein the dust collection bin includes a case including a magnet configured to generate magnetism around an opening, a cover configured to open or close the opening, and a sealing member configured to seal between the cover and the case and being magnetic to be deformable in shape by the magnet.

Also, the sealing member includes a first sealing portion configured to cover the opening, and a second sealing portion extending from the first sealing portion and being in contact with an inner wall of the case.

The magnet may be positioned at a location capable of providing an attraction force to the second sealing portion in a closed state of the cover.

Also, the second sealing portion may further include a free end that is deformable in shape by the magnet.

Also, the sealing member includes a first material (rubber) which is at least one of nitrile-butadiene rubber (NBR), silicon rubber, thermoplastic polyurethane (TPU), or triethyl phosphate (TEP), and a second material obtained by mixing the first material with iron or steel powder of a size of 1 μm to 100 μm by 10 weight percent (wt %) to 80 wt %.

Also, the dust collection bin may further include a torsion spring configured to rotate the cover with respect to the cleaner body, wherein one end of the torsion spring is connected with the cover and the other end of the torsion spring is connected with the case.

The dust collection bin according to the disclosure may achieve complete locking by using the gasket having functionality.

Also, an effect of automatic opening/closing of opening, upon discharging of dust through an automatic dust discharge system, the cover of the dust collection bin by suction and automatically returning the open cover to a closed position upon operation completion of the automatic dust discharge system may be provided.

At this time, the gasket having magnetism may be deformed and tightly pressed against the wall of the dust collection bin, thereby performing complete sealing.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first," "second," etc., used in the disclosure may be used to describe various components, these components should not be limited by these terms. These terms are only used to distinguish one component from another. For example, a first component could be termed a second component, and, similarly, a second component could be termed a first component, without departing from the scope of the disclosure. The term "and/or" includes any and all combinations of one or more of associated listed items.

Also, in the following description, the terms "front end," "rear end," "upper portion," "lower portion," "upper end," "lower end," etc., are defined based on the drawings, and the shapes and positions of the components are not limited by the terms.

The disclosure may be applied to all home appliances such as a cleaning apparatus that uses a dust collection bin having a cover with a gasket.

Figure 1:
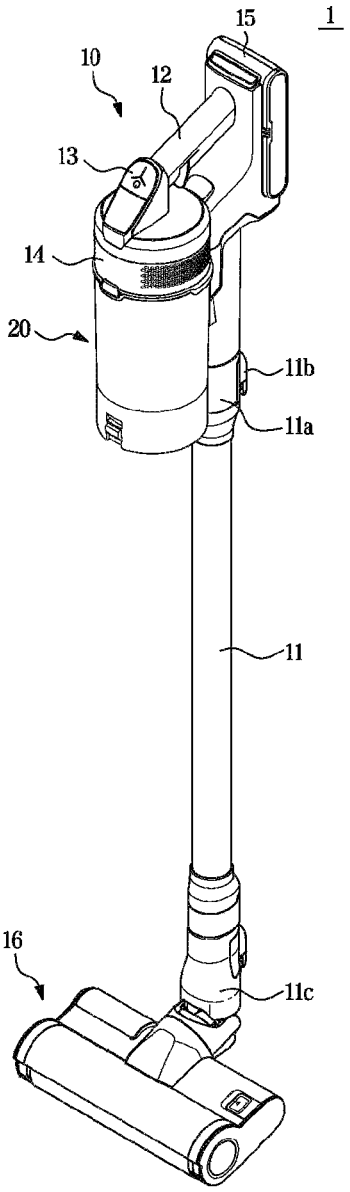
FIG. 1 is a perspective view of a cleaning apparatus including a dust collection bin according to an embodiment of the disclosure.
Figure 2:
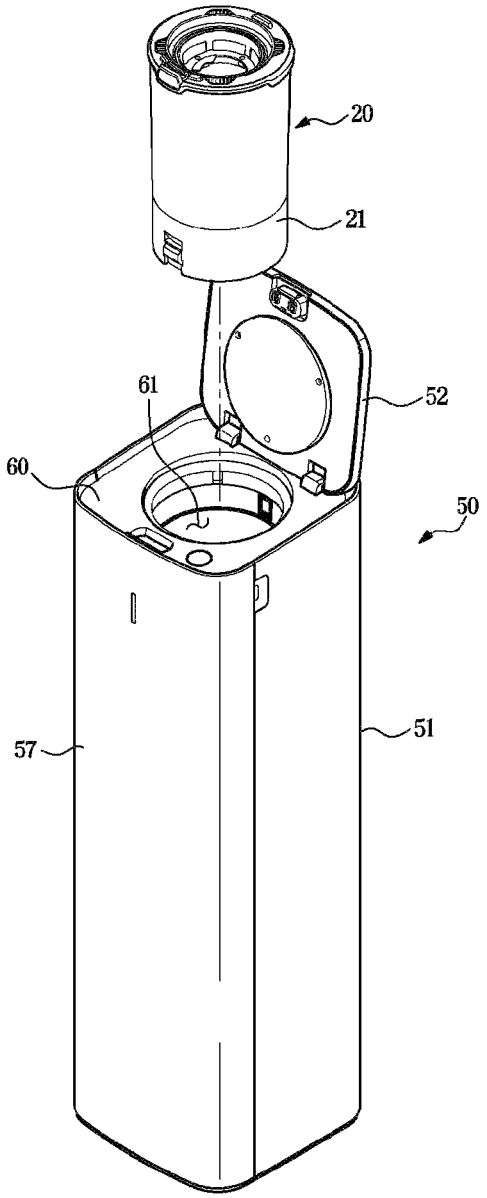
FIG. 2 shows a state in which a dust collection bin is docked with a docking station according to an embodiment of the disclosure.
Figure 3:
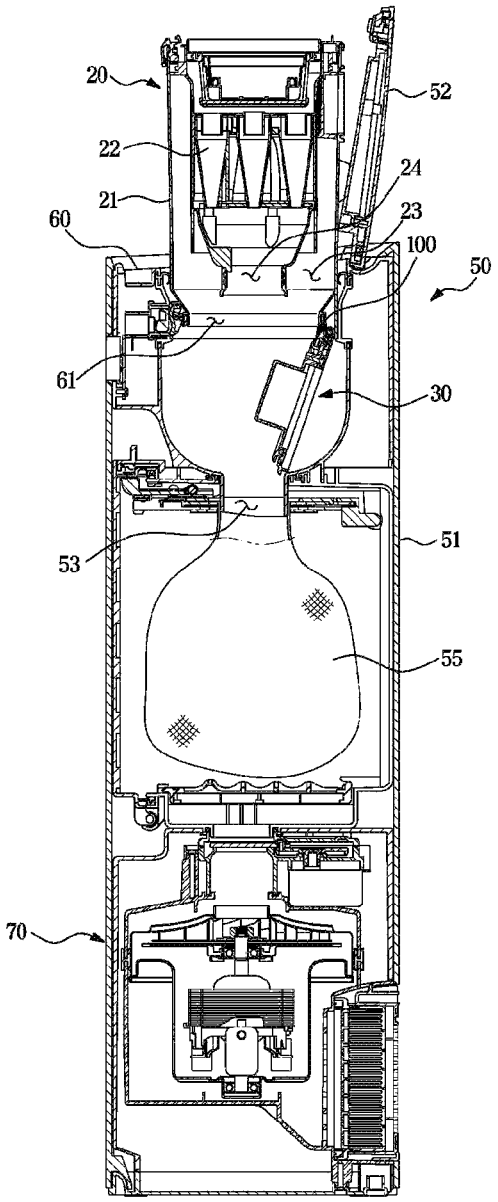
FIG. 3 is a side cross-sectional view of a docking station in which a dust collection bin is installed according to an embodiment of the disclosure.

FIG. 1 is a perspective view of a cleaning apparatus including a dust collection bin according to an embodiment of the disclosure, FIG. 2 shows a state in which a dust collection bin is docked with a docking station according to an embodiment of the disclosure, and FIG. 3 is a side cross-sectional view of a docking station in which a dust collection bin is installed according to an embodiment of the disclosure.

Referring to FIGS. 1 to 3, a cleaning apparatus 1 may include a cleaner body 10, an extension pipe 11 detachably coupled to the cleaner body 10, a suction unit 16 detachably coupled to the extension pipe 11, and a dust collection bin 20 detachably coupled to the cleaner body 10.

The cleaner body 10 may include a suction motor (not shown) for generating a suction force required for sucking foreign materials existing on a floor to be cleaned, and the dust collection bin 20 for collecting foreign materials sucked from the floor to be cleaned.

The dust collection bin 20 may be configured to filter dust, rubbish, etc. included in air sucked through the suction unit 16 and collect the dust, rubbish, etc. The dust collection bin 20 may be detachable from the cleaner body 10.

The cleaner body 10 may include a filter housing 14. The filter housing 14 may be substantially in a donut shape and accommodate a filter (not shown) therein. The filter is not limited in kind, and for example, a high efficiency particulate air (HEPA) filter may be positioned inside the filter housing 14. The filter may filter ultrafine duct, etc. not filtered in the dust collection bin 20.

The cleaner body 10 may include a handle 12 which a user grips to control the cleaning apparatus 1. The user may perform cleaning by moving the cleaning apparatus 1 in a front-rear direction while gripping the handle 12.

The cleaner body 10 may further include a controller 13. The user may turn on/off the cleaning apparatus 1 or adjust suction strength by controlling a power button, etc. provided in the controller 13.

The suction unit 16 may contact a floor to be cleaned. The suction unit 16 may suck foreign materials such as dust existing on the floor to be cleaned by contacting the floor to be cleaned.

The suction unit 16 may be connected with the cleaner body 10 by the extension pipe 11. One end of the extension pipe 11 may be pivotally connected with the suction unit 16 such that the suction unit 16 performs a joint movement with respect to the extension pipe 11.

The extension pipe 11 of the cleaner body 10 may include an extension pipe connecting portion 11*a*. The extension pipe connecting portion 11*a* may separate the extension pipe 11 from the cleaner body 10 or couple the extension pipe 11 to the cleaner body 10. The extension pipe 11 may include an extension pipe separating button 11*b*. The user may separate the extension pipe 11 from the cleaner body 10 by pressing the extension pipe separating button 11*b*. The user may separate the extension pipe 11 from the cleaner body 10 and then connect the suction unit 16 directly with the cleaner body 10.

The extension pipe 11 of the cleaner body 10 may include a suction unit connecting portion 11*c*. The suction unit connecting portion 11*c* may separate the suction unit 16 from the cleaner body 10 or couple the suction unit 16 to the cleaner body 10.

The cleaner body 10 may further include a battery 15. The battery 15 may be detachably installed in the cleaner body 10.

Also, the battery 15 may be electrically connected with a charging terminal provided in a cleaner mounting device or a docking station 50, which is not shown. The battery 15 may be charged by receiving power from the charging terminal provided in the docking station 50.

The cleaning apparatus 1 may be stored or mounted in the docking station 50.

The docking station 50 may include a docking station housing 51 forming an appearance. The docking station 50 may include a docking housing 60 with which the dust collection bin 20 is docked. The docking station 50 may automatically discharge collected materials by changing a suction air current that is supplied to the dust collection bin 20 of the cleaning apparatus 1. That is, by docking the dust collection bin 20 of the cleaning apparatus 1 with the docking station 50, automatic discharging by the docking station 50 may be performed. Accordingly, by separating the dust collection bin 20 from the cleaner body 10 of the cleaning apparatus 1 and then docking the dust collection bin 20 with the docking station 50, dust collected in the dust collection bin 20 may be automatically discharged. An embodiment of the disclosure shows an example in which a docking station is docked with a dust collection bin separated to automatically discharge dust collected in the dust collection bin. However, a concept of the disclosure is not limited to this. For example, the cleaning apparatus 1 may be docked with the docking station 50 to automatically discharge dust collected in the dust collection bin 20.

The docking station housing 51 may include a docking station cover 52 for opening or closing the docking housing 60. The docking station housing 51 may have a major axis extending in one direction. The major axis may extend preferably in an up-down direction. Accordingly, the docking station 50 may be in a shape of a box extending substantially in the up-down direction.

The docking station housing 51 may include a panel 57 that is detachable from a front side of the docking station housing 51. By separating the panel 57 from the docking station housing 51, the user may easily replace a dust bag 55 positioned inside the docking station housing 51.

The docking station 50 may include a suction device 70 to discharge dust collected in the dust collection bin 20 from the dust collection bin 20. The suction device 70 may be positioned below the docking housing 60.

The docking station 50 may include a suction flow path 53 through which foreign materials discharged from the dust collection bin 20 is sucked into the dust bag 55 in the docking housing 60.

The dust bag 55 may be formed of a material that does not pass foreign materials while transmitting air to collect foreign materials entered the dust bag 55 from the dust collection bin 20.

The docking housing 60 may include a resting portion 61 which communicates with the suction flow path 53 and on which the dust collection bin 20 is rested. The resting portion 61 may open upward with respect to the major axis of the docking housing 60. The resting portion 61 may open to outside in the docking housing 60, and the dust collection bin 20 may be inserted in the up-down direction in the docking housing 60 and rested on the resting portion 61. Accordingly, upon docking of the dust collection bin 20 with the docking station 50, a major axis of the dust collection bin 20 may substantially correspond to the major axis of the docking station housing 51.

The dust collection bin 20 may be in a shape of a cylinder having a major axis that extends in one direction. The dust collection bin 20 may separate foreign materials therein through a centrifugal rotation. A multicyclone 22 may be positioned inside the dust collection bin 20. The dust collection bin 20 may collect foreign materials below the multicyclone 22. The dust collection bin 20 may include a first dust collector 23 for primarily collecting relatively great foreign materials, and a second dust collector 24 for collecting relatively small foreign materials by the multicyclone 22.

Both the first dust collector 23 and the second dust collector 24 may open to the outside upon opening of a cover 30 of the dust collection bin 20.

Accordingly, upon opening of the cover 30 positioned in a lower portion of the dust collection bin 20, foreign materials collected in the dust collection bin 20 may be easily discharged to the resting portion 61.

The suction flow path 53 may transfer a flow of an air current generated by the suction device 70 to the dust collection bin 20. A suction air current generated by the suction device 70 may be transferred to inside of the dust collection bin 20 along the suction flow path 53 and the resting portion 6, and foreign materials collected inside the dust collection bin 20 may be discharged from the dust collection bin 20 to the dust bag 55 according to a flow of the suction air current.

After the docking station 50 is driven and foreign materials are collected in the dust bag 55, the user may separate the panel 57, separate the dust bag 55, and then discharge the collected foreign materials from the docking station 50.

Figure 4:
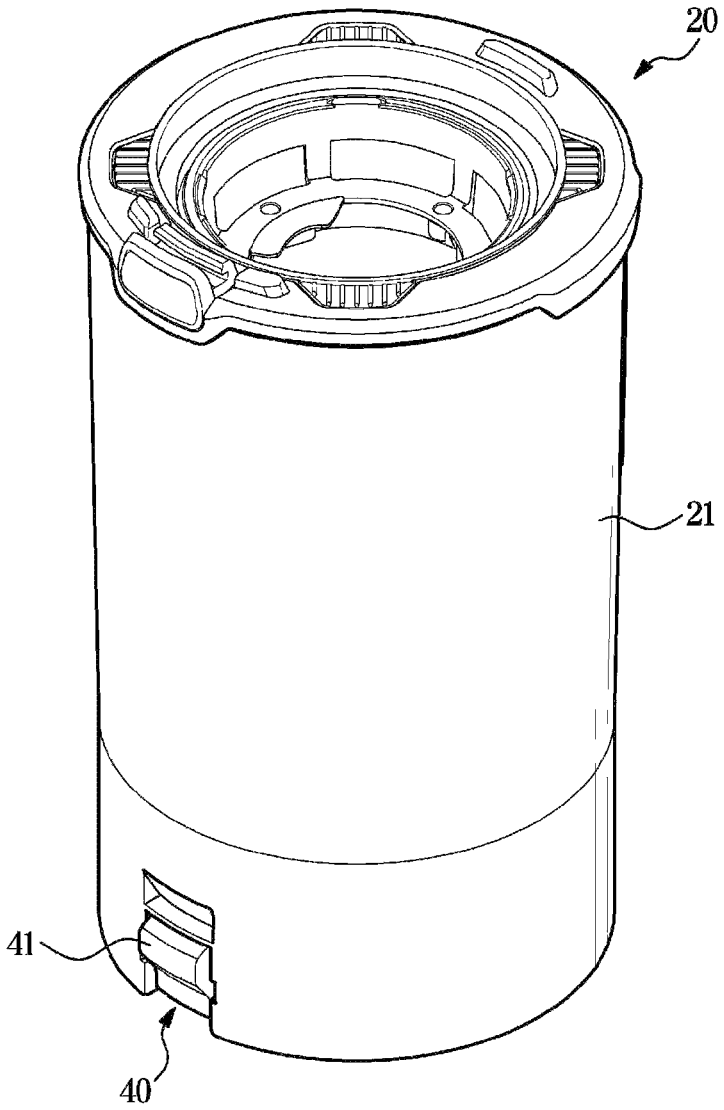
FIG. 4 is a perspective view of a dust collection bin according to an embodiment of the disclosure.
Figure 5:
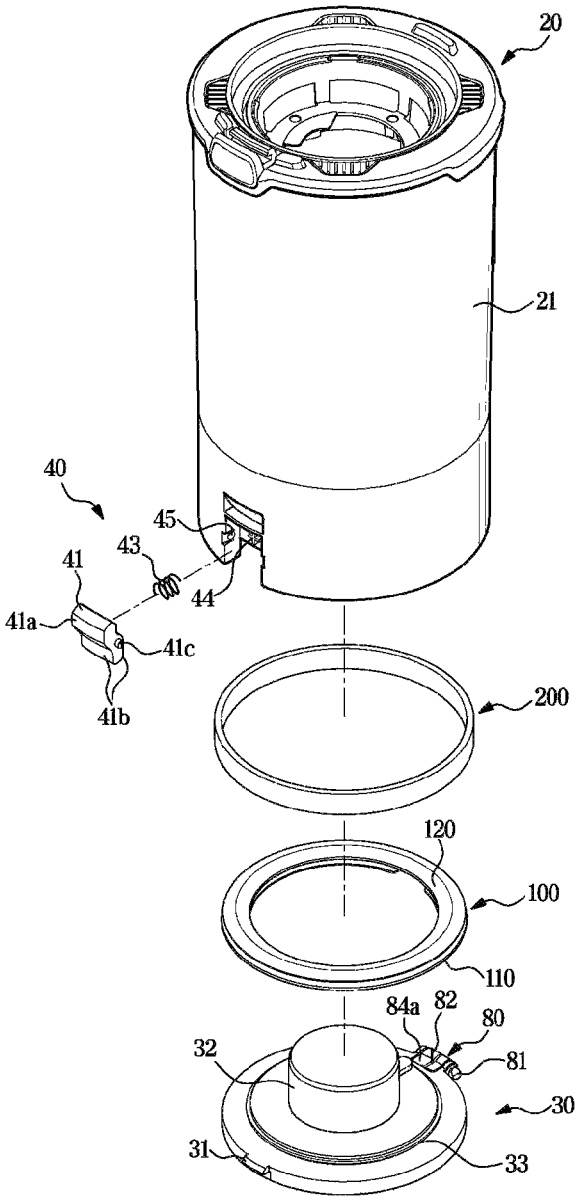
FIG. 5 is an exploded perspective view of a dust collection bin according to an embodiment of the disclosure.
Figure 6:
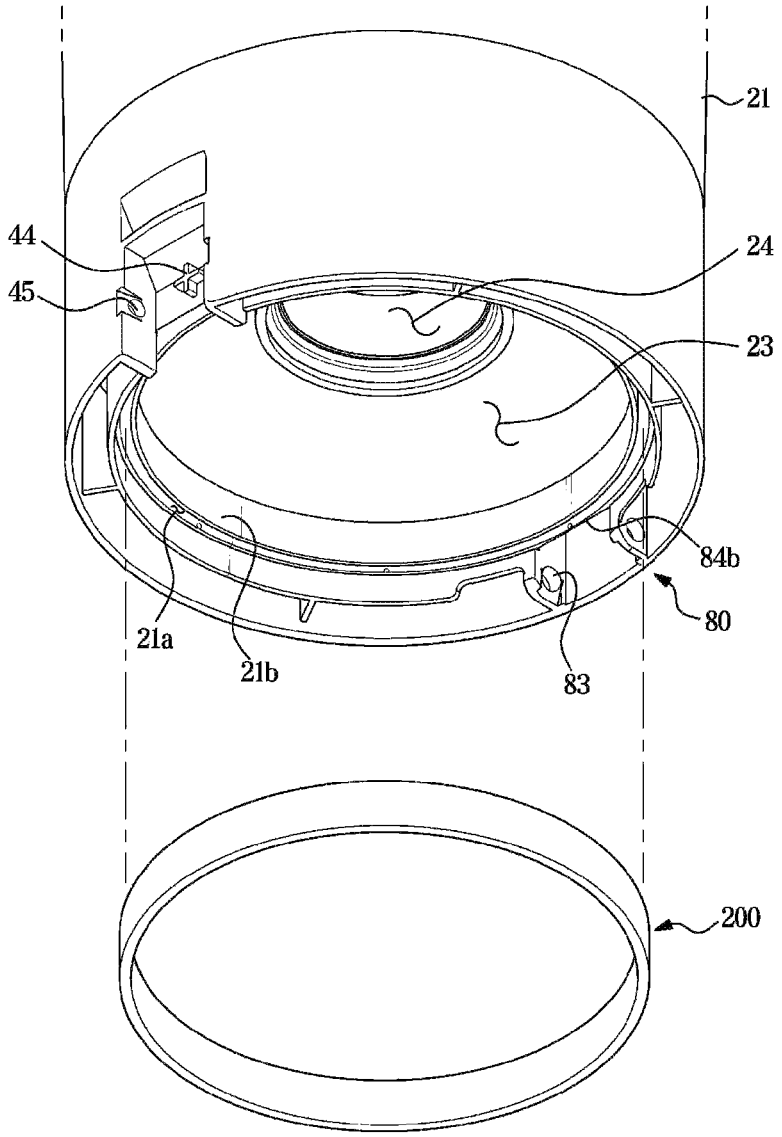
FIG. 6 shows a magnet that is installed in a dust collection bin case according to an embodiment of the disclosure.
Figure 7:
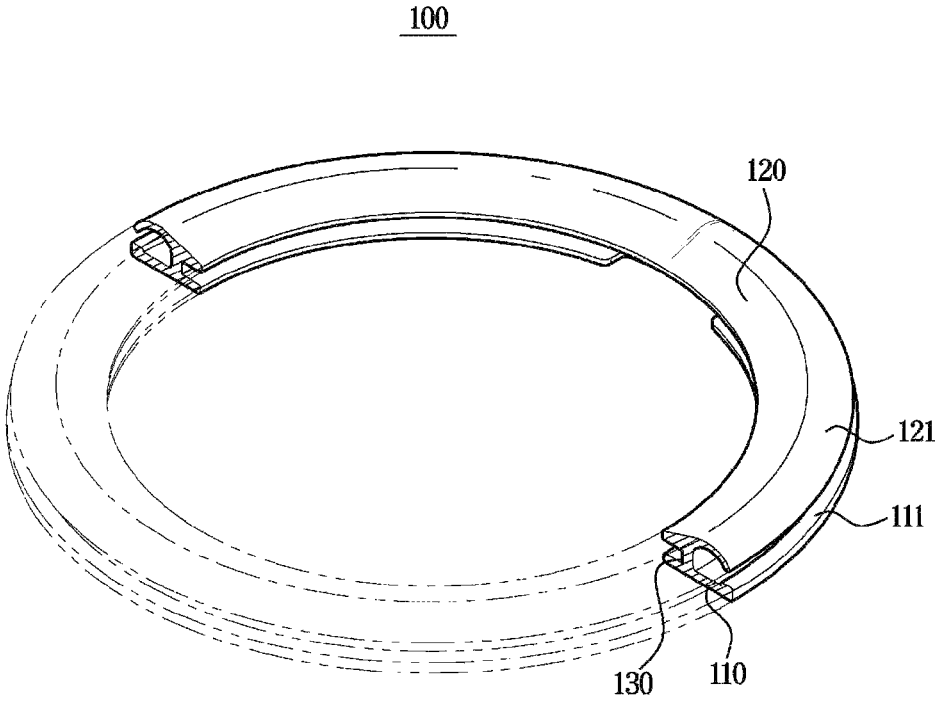
FIG. 7 is a cross-sectional perspective view of a sealing member that is installed in a dust collection bin cover according to an embodiment of the disclosure.

FIG. 4 is a perspective view of a dust collection bin according to an embodiment of the disclosure, FIG. 5 is an exploded perspective view of a dust collection bin according to an embodiment of the disclosure, FIG. 6 shows a magnet that is installed in a dust collection bin case according to an embodiment of the disclosure, and FIG. 7 is a cross-sectional perspective view of a sealing member that is installed in a dust collection bin cover according to an embodiment of the disclosure.

Referring to FIGS. 4 to 7, the dust collection bin 20 may include a case 21, and the cover 30 for opening or closing the case 21 upon docking with the docking station 50.

The case 21 of the dust collection bin 20 may be in a shape of a cylinder, although not limited thereto. However, the dust collection bin 20 may be in a shape of a polygonal pipe. In a lower side of the case 21, an opening 21*a* may be formed.

In a lower end of the case 21, an opening forming portion 21*b* extending to form the opening 21*a* may be provided. The opening forming portion 21*b* may be provided in the lower end of the case 21.

The dust collection bin 20 may include the cover 30 for opening or closing the opening 21*a* of the case 21. The cover 30 may be positioned in the lower end of the case 21 and open or close the lower end of the case 21.

The dust collection bin 20 may include the first dust collector 23 for primarily collecting relatively great foreign materials, and the second dust collector 24 for collecting relatively small foreign materials by the multicyclone 22, as described above.

Both the first dust collector 23 and the second dust collector 24 may open to the outside upon opening of the dust collection bin 20 by the cover 30. Upon opening of the cover 30, both the first dust collector 23 and the second dust collector 24 may open to the outside.

The cover 30 may include a locking protrusion 31 that is coupled to the case 21 to maintain a state of closing the dust collection bin 20, a cap portion 32 that prevents foreign materials collected in the second dust collector 24 from being scattered to the outside upon closing of the dust collection bin 20, and a sealing member coupling protrusion 33 that is coupled to a sealing member 100 which will be described below.

In the case 21 of the dust collection bin 20, a locking device 40 for supporting the locking protrusion 31 of the cover 30 to prevent the cover 30 from departing from the lower end of the dust collection bin 20 may be provided.

The locking device 40 may lock the cover 30 to the case 21 or unlock the cover 30 from the case 21. The locking device 40 may include a locking member 41 for fixing the cover 30 to the case 21 and releasing locking of the cover 30 by being pressed by an external force.

The locking device 40 may be provided in the case 21. The locking device 40 of the case 21 may be positioned to correspond to the locking protrusion 31 of the cover 30. The locking member 41 may be installed at a location corresponding to the locking protrusion 31 of the cover 30. The locking member 41 may be hook-coupled to the locking protrusion 31 to prevent the locking protrusion 31 from departing from the case 21.

The locking member 41 may rotate on a shaft 41c by being pressed by an external force. The shaft 41c of the locking member 41 may be rotatably coupled to a shaft coupling groove 45 provided in the case 21. The locking member 41 may include a push portion 41*a* that rotates by being pressed by an external force to release hook-coupling with the locking protrusion 31, and a hook portion 41*b* that interworks with the push portion 41*a* and is hook-coupled to the locking protrusion 31.

The locking device 40 may include an elastic member 43 for maintaining a state in which the hook portion 41*b* is hook-coupled to the locking protrusion 31 while the locking member 41 is not pressed by the push portion 41*a* of the locking member 41. The elastic member 43 may be installed in an elastic member installing portion 44 formed in the case 21.

The elastic member 43 may be biased to press the hook portion 41*b* toward the locking protrusion 31 such that hook-coupling of the hook portion 41*b* to the locking protrusion 31 is maintained while the cover 30 is in a closed state. That is, the elastic member 43 may press the hook portion 41*b* in an opposite direction of a radial direction of the case 21 to press the hook portion 41*b* toward the locking protrusion 31. Upon application of a pressing force that is greater than an elastic force of the elastic member 43 to the push portion 41*a*, the hook portion 41*b* may rotate by interworking with the push portion 41*a*, and hook-coupling of the hook portion 41*b* to the locking protrusion 31 may be released.

At this time, the cover 30 may depart from the case 21 by gravity to rotate downward on a rotation device 80 which will be described below, and accordingly, the lower end of the case 21 may open.

The push portion 41*a* may protrude outward from an outer circumference of the case 21 in a radial direction of a central axis of the case 21. The user may easily press the push portion 41*a* of the locking member 41, protruding outward from the outer circumference of the case 21, to open the dust collection bin 20.

The cover 30 may be rotatable by the rotation device 80 at one side of the lower end of the case 21. The rotation device 80 may be opposite to the locking device 40.

The rotation device 80 may include a rotation shaft 81 provided on the cover 30, and a torsion spring 82 coupled to the rotation shaft 81 and supporting the cover 30 and the case 21. One end of the torsion spring 82 may support the cover 30, and the other end of the torsion spring 82 may support the case 21. The torsion spring 82 may include a first support 82*a* for supporting the cover 30, and a second support portion 82*b* for supporting the case 21 (see FIG. 8). The cover 30 may rotate on the rotation shaft 81 of the cover 30 and then return to an original state by an elastic force of the torsion spring 82.

The cover 30 may include a first torsion spring installing portion 84*a* on which the first support 82*a* of the torsion spring 82 is supported. An embodiment of the disclosure shows an example in which the first torsion spring installing portion 84*a* is a bracket for supporting the first support 82*a* of the torsion spring 82. However, a concept of the disclosure is not limited to this. A torsion spring installing portion may have any shape capable of supporting both ends of a torsion spring.

The rotation device 80 may include a rotation shaft coupling portion 83 provided in the case 21, wherein the rotation shaft 81 of the cover 30 is coupled to the rotation shaft coupling portion 83. In the rotation shaft coupling portion 83 of the case 21, a second torsion spring installing portion 84*b* may be provided to support the second support portion 82*b* of the torsion spring 82.

The rotation shaft 81 of the cover 30 may be rotatably coupled to the rotation shaft coupling portion 83 of the case 21. The cover 30 may rotate on the rotation shaft 81 coupled to the rotation shaft coupling portion 83 of the case 21 to open or close the lower end of the case 21.

Around the opening 21*a* formed in the lower end of the case 21, a magnet 200 for generating a magnetic force may be provided. The magnet 200 may be provided around the opening 21*a* of the case 21. The magnet 200 may be in a shape of a ring. An embodiment of the disclosure shows an example in which a magnet is in a shape of a ring corresponding to a case being in a shape of a cylinder. However, a concept of the disclosure is not limited to this. The magnet may correspond to the shape of the case.

In the case 21, a magnet installing portion 210 for installing the magnet 200 being in a shape of a ring therein may be provided. The magnet installing portion 210 may be provided around the opening 21*a* formed in the lower end of the case 21. The magnet installing portion 210 may be provided in an outer circumference of the opening forming portion 21*b*. The magnet installing portion 210 may be provided in a circumference of the opening 21*a* to generate a magnetic force around the opening 21*a*. The magnet installing portion 210 may be provided in the entire circumference of the opening 21*a* to improve a sealing force with the cover 30. The magnet 200 may be inserted in the magnet installing portion 210 provided in the opening 21*a* of the case 21.

On the cover 30, the sealing member 100 for sealing with the case 21 may be provided. The sealing member 100 may be provided on an outer edge of the cover 30. The sealing member 100 may be in a shape of a ring. An embodiment of the disclosure shows an example in which the sealing member 100 is in a shape of a ring corresponding to the opening 21*a* being in a shape of a cylinder. However, a concept of the disclosure is not limited to this. For example, the sealing member may have a polygonal shape for sealing between a case having a polygonal shape and a cover having a polygonal shape.

The sealing member 100 may be formed of a material having magnetism to be deformable by the magnet 200. The sealing member 100 may be formed of a material having magnetism. The sealing member 100 may be formed of a material that generates an attraction force with respect to the magnet 200.

The sealing member 100 may include a first material (rubber) which is at least one of nitrile-butadiene rubber (NBR), silicon rubber, thermoplastic polyurethane (TPU), or triethyl phosphate (TEP).

The sealing member 100 may include a second material obtained by mixing the first material with iron or steel powder having a size of 1 μm to 100 μm by 10 weight percent (wt %) to 80 wt %.

The sealing member 100 may be formed of a material obtained by mixing the first material based on rubber with the second material including a metal.

The sealing member 100 may include a first sealing portion 110, and a second sealing portion 120 extending from the first sealing portion 110. The first sealing portion 110 and the second sealing portion 120 may be integrated into one body. An embodiment of the disclosure shows an example in which the first sealing portion and the second sealing portion are integrated into one body. However, a concept of the disclosure is not limited to this. For example, the first sealing portion and the second sealing portion may be prepared separately and then coupled to each other.

The sealing member 100 may seal between the case 21 and the cover 30 upon closing of the cover 30. The sealing member 100 may seal between the opening 21*a* of the case 21 and the cover 30 upon closing of the cover 30. The sealing member 100 may be provided on an outer edge of the cover 30.

The first sealing portion 110 of the sealing member 100 may be in contact with an upper surface of the cover 30. The first sealing portion 110 may be positioned on an outer edge of the cover 30. The first sealing portion 110 may include an opening cover portion 111 formed on the outer edge to cover the opening 21*a* of the case 21. The opening cover portion 111 may correspond to the opening forming portion 21*b* forming the opening 21*a* of the case 21. The opening cover portion 111 may be in contact with the opening forming portion 21*b* of the case 21. The opening cover portion 111 of the first sealing portion 110 may be in contact with the opening forming portion 21*b* forming the opening 21*a* of the case 21 to seal the opening 21*a*.

The second sealing portion 120 of the sealing member 100 may extend from the first sealing portion 110. The second sealing portion 120 may be connected with the first sealing portion 110 through a cover coupling portion 130. The cover coupling portion 130 may be coupled to a sealing member coupling protrusion 33 formed in the cover 30. The cover coupling portion 130 may be formed in a shape of a groove to correspond to the sealing member coupling protrusion 33 of the cover 30. The cover coupling portion 130 may be inserted in the sealing member coupling protrusion 33 to couple the sealing member 100 to the cover 30.

The second sealing portion 120 may be located above the first sealing portion 110. An inner side of the second sealing portion 120 may be in contact with the cover 30 and supported by the cover 30. An outer side of the second sealing portion 120 may be in contact with an inner surface of the case 21 upon coupling of the cover 30 with the case 21. The second sealing portion 120 may be located above the first sealing portion 110 and tightly pressed against an inner wall of the case 21 to seal the case 21. At least one part of the second sealing portion 120 may be formed as a curved surface. The second sealing portion 120 may change in shape by an attraction force of the magnet 200 provided in the case 21. At least one part of the second sealing portion 120 may be deformable by the magnet 200 of the case 21. At least one part of the second sealing portion 120 may be deformed by the magnet 200 of the case 21 to be tightly pressed against the inner wall of the case 21.

The second sealing portion 120 may include a free end 121 that is deformable in shape by the magnet 200. The free end 121 may be provided in an outer edge of the second sealing portion 120. At least one portion of the free end 121 may be formed as a curved surface. At least one portion of the free end 121 may be deformable in shape by the magnet 200. At least one portion of the free end 121 may be deformable to be tightly pressed against the inner wall of the case 21 by the magnet 200.

In a closed state of the cover 30, the second sealing portion 120 of the sealing member 100 may stick to the inner wall of the case 21 by the magnet 200 to block leakage of air and achieve complete sealing. Also, a closed position and state of the cover 30 that sticks to the inner wall of the case 21 by magnetism of the magnet 200 may be checked.

The magnet 200 of the case 21 may be positioned at a location corresponding to the sealing member 100 such that the sealing member 100 applies a sealing force to the case 21 in a closed state of the cover 30. The magnet 200 of the case 21 may be positioned at a location of applying an attraction force to the second sealing portion 120 such that the second sealing portion 120 of the sealing member 100 is tightly pressed against the case 21 in the closed state of the cover 30.

An embodiment of the disclosure shows an example in which the second sealing portion 120 has a constant thickness. However, a concept of the disclosure is not limited to this. For example, the free end 121 of the second sealing portion 120 may have different thicknesses.

Figure 8:
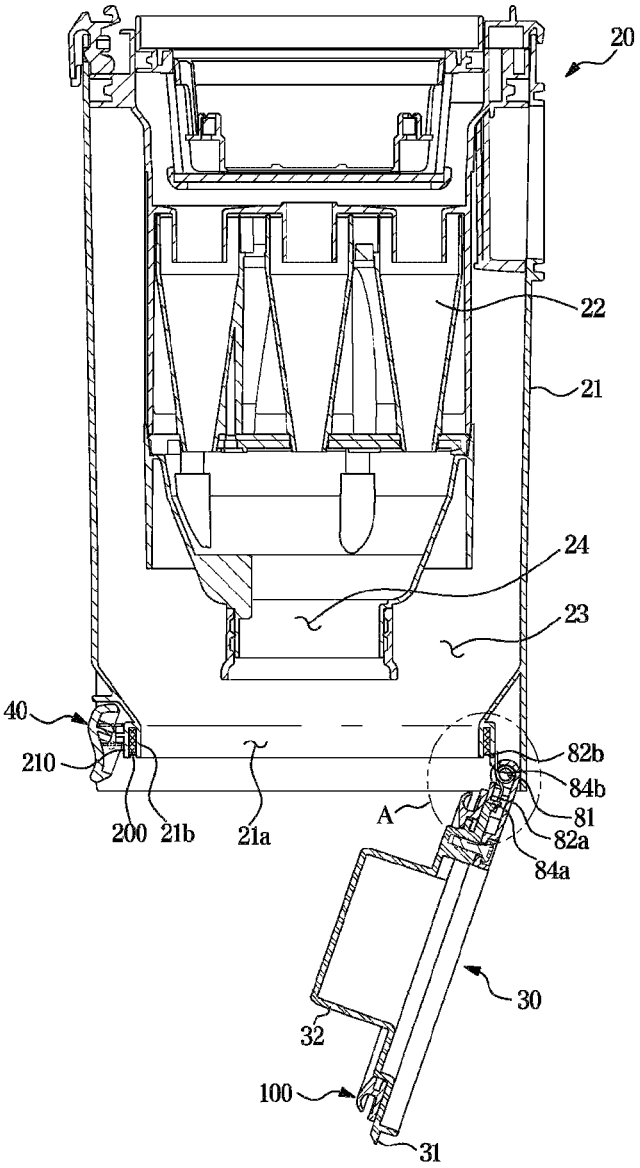
FIG. 8 is a side cross-sectional view of a dust collection bin showing an open state of a dust collection bin cover according to an embodiment of the disclosure.
Figure 9:
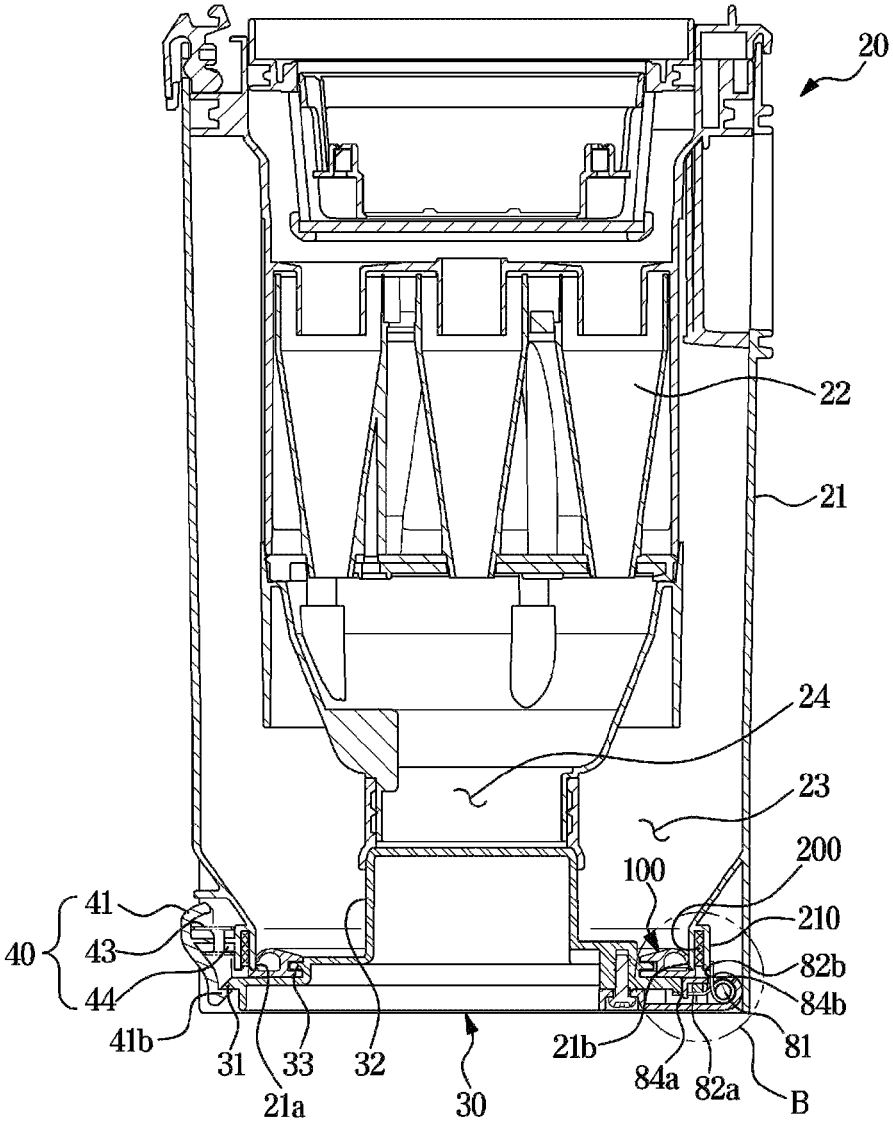
FIG. 9 shows a closed state of a dust collection bin cover according to an embodiment of the disclosure.
Figure 10:
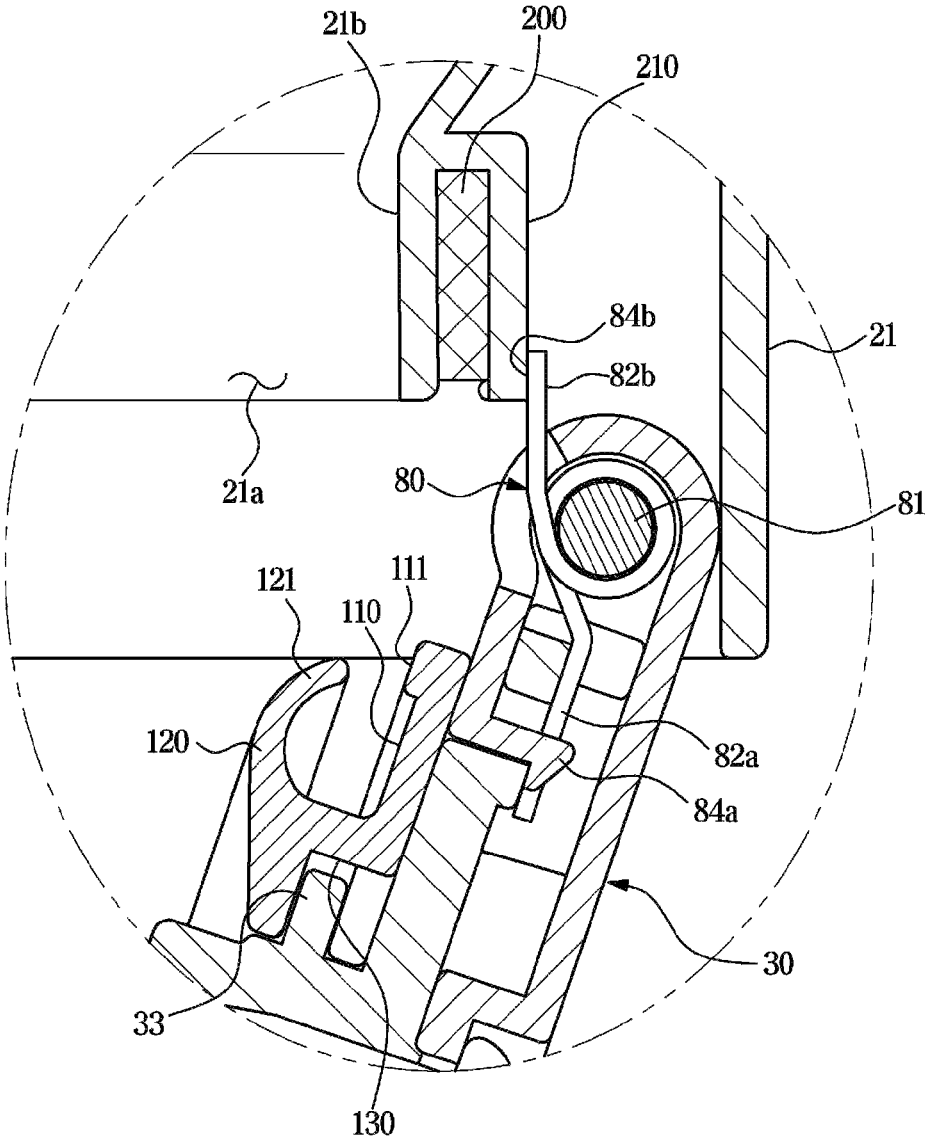
FIG. 10 is an enlarged view of an area A of FIG. 8, showing a state of a sealing member while a dust collection bin cover opens according to an embodiment of the disclosure.
Figure 11:
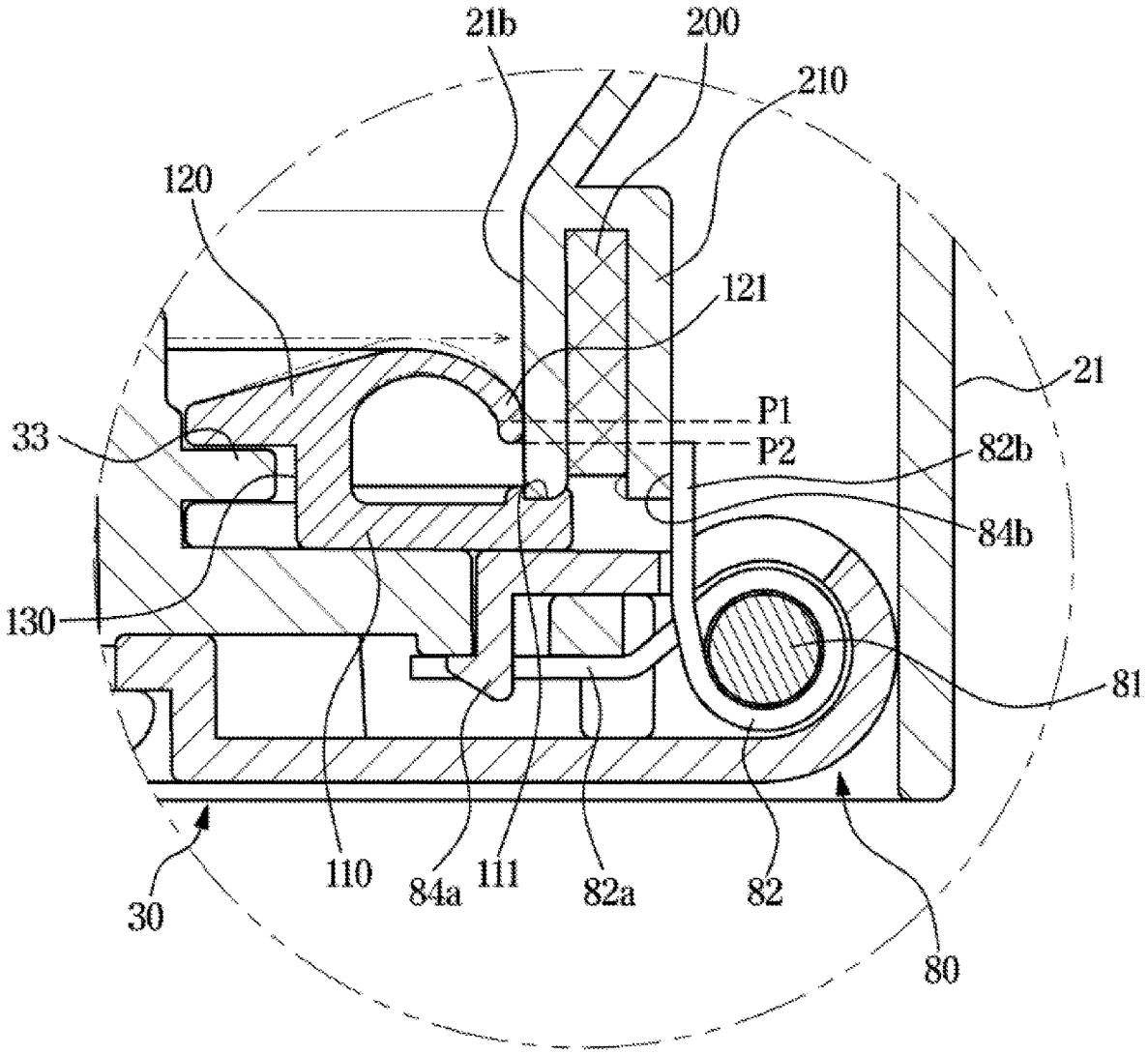
FIG. 11 is an enlarged view of an area B of FIG. 9, showing a state of a sealing member while a dust collection bin cover is closed according to an embodiment of the disclosure.

FIG. 8 is a side cross-sectional view of a dust collection bin, showing an open state of a dust collection bin cover according to an embodiment of the disclosure, FIG. 9 shows a closed state of a dust collection bin cover according to an embodiment of the disclosure, FIG. 10 is an enlarged view of an area A of FIG. 8, showing a state of a sealing member while a dust collection bin cover opens according to an embodiment of the disclosure, and FIG. 11 is an enlarged view of an area B of FIG. 9, showing a state of a sealing member while a dust collection bin cover is closed according to an embodiment of the disclosure.

Referring to FIGS. 8 to 11, the cover 30 of the dust collection bin 20 may open or close the opening 21*a* of the case 21.

The cover 30 may open the opening 21*a* formed in the lower end of the case 21 by rotating by the rotation device 80 positioned at one side of the lower end of the case 21.

The cover 30 and the case 21 may be locked or unlocked by the locking device 40. To open the cover 30, the user may release locking by pushing the locking member 41 of the locking device 40.

In an open state, the locking protrusion 31 of the cover 30 may be unlocked from the locking member 41, and the cover 30 may rotate with respect to the case 21 on the rotation shaft 81. At this time, the case 21 may be supported by the second support portion 82*b* of the torsion spring 82 connected with the rotation shaft 81, and the cover 30 may be supported by the first support portion 82*a* of the torsion spring 82.

In the open state of the cover 30, the sealing member 100 provided in the cover 30 may be spaced from the opening 21*a* of the case 21, and accordingly, the shape of the sealing member 100 may be not deformed.

The cover 30 may return to an original position by the torsion spring 82. The cover 30 may rotate on the rotation shaft 81 by a restoring force of the torsion spring 82. The cover 30 may return toward the opening 21*a* of the case 21 to close the opening 21*a*.

Upon returning of the cover 30 to the original position, the opening 21*a* of the case 21 may be closed by the cover 30. By coupling of the locking protrusion 31 of the cover 30 to the locking member 41 by the locking device 40, the cover 30 may be locked to the case 21.

At this time, the first sealing portion 110 of the sealing member 100 provided on the cover 30 may contact the opening forming portion 21*b* forming the opening 21*a* of the case 21 to cover the opening 21*a*, and the second sealing portion 120 of the sealing member 100 may be deformed by the magnet 200 provided around the opening 21*a* of the case 21 and tightly pressed to the inner wall of the case 21 to thus completely seal the opening 21*a* of the case 21.

The free end 121 of the second sealing portion 120 may move from a first position P1 to a second position P2 to contact the inner surface of the case 21 at a wider area by magnetism of the magnet 200. The second position P2 may be lower than the first position P1. The first position P1 and the second position P2 may change according to a position of the magnet 200. The second position P2 may be higher than a lower end of the magnet 200.

Accordingly, in a closing operation of the cover 30, the cover 30 may primarily close the opening 21*a* formed in the lower end of the case 21 by the rotation device 80, and the sealing member 100 provided on the cover 30 may be deformed by an attraction force of the magnet 200 provided in the opening 21*a* of the case 21 such that the second sealing portion 120 is tightly pressed against the inner wall of the case 21 to secondarily close the opening 21*a*, thereby achieving complete closing of the case 21 by the cover 30.

Figure 12:
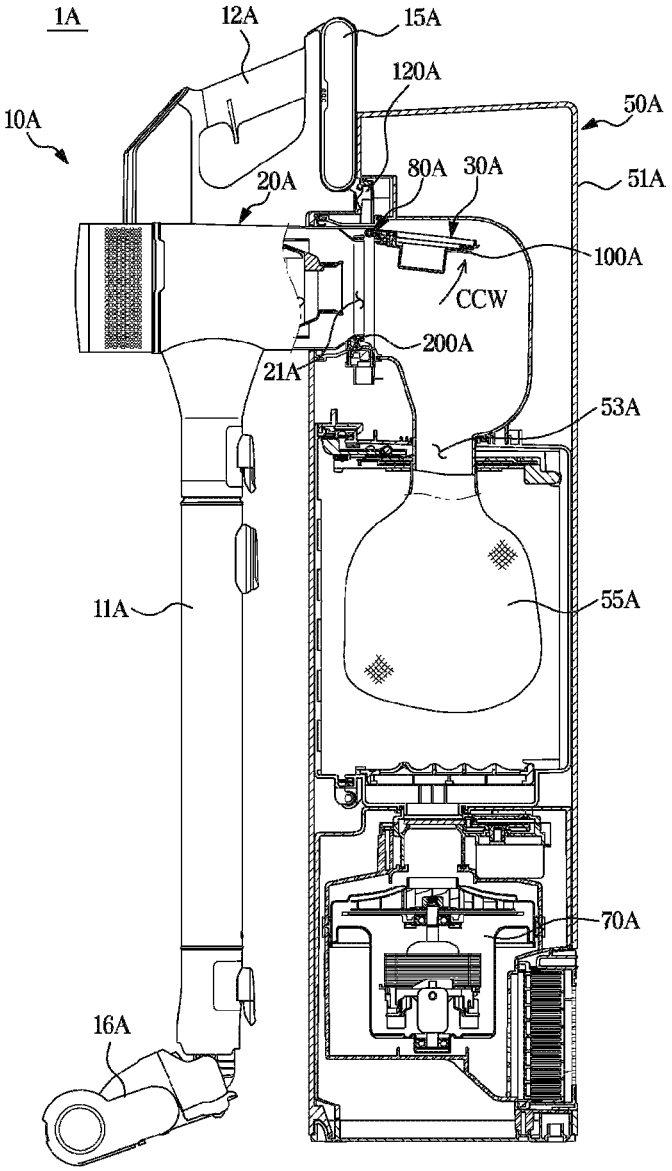
FIG. 12 is a side cross-sectional view showing a cleaning apparatus including a dust collection bin and a docking station including the dust collection bin according to an embodiment of the disclosure.

FIG. 12 is a side cross-sectional view showing a cleaning apparatus including a dust collection bin and a docking station including the dust collection bin according to an embodiment of the disclosure.

Referring to FIG. 12, a cleaning apparatus 1A may include a cleaner body 10A, an extension pipe 11A detachably coupled to the cleaner body 10A, a suction unit 16A detachably coupled to the extension pipe (not shown), and a dust collection bin 20A detachably coupled to the cleaner body 10A.

The cleaner body 10A may include a handle 12A which a user grips to control the cleaning apparatus 1A. The cleaner body 10A may further include a battery 15A. The battery 15A may be detachably installed in the cleaner body 10A.

The battery 15A may be electrically connected with a charging terminal 120A provided in a cleaner mounting device or a docking station 50A. The battery 15A may be charged by receiving power from the charging terminal provided in the docking station 50A.

The cleaning apparatus 1A may be stored in or mounted on the docking station 50A. The docking station 50A may include a docking station housing 51A forming an appearance.

The docking station 50A may automatically discharge collected materials by changing a suction air current that is supplied to the dust collection bin 20A of the cleaning apparatus 1A.

By docking the cleaner body 10A of the cleaning apparatus 1A with the docking station 50A, the battery 15A may be charged and dust collected in the dust collection bin 20A may be automatically discharged.

The docking station housing 51 may have a major axis extending in one direction. The major axis may extend preferably in an up-down direction. Accordingly, the docking station 50 may be in a shape of a box extending substantially in the up-down direction.

The docking station 50A may include a suction device 70A to discharge dust collected in the dust collection bin 20A from the dust collection bin 20A. The docking station 50A may include a suction flow path 53A through which foreign materials discharged from the dust collection bin 20A is sucked into a dust bag 55A.

Upon docking of the cleaning apparatus 1A with the docking station 50A, a major axis of the dust collection bin 20A may be perpendicular to the major axis of the docking station 50A.

The dust collection bin 20A may be docked with the docking station 50A at a side of the docking station 50A. Accordingly, a cover 30A of the dust collection bin 20A may be rotatably coupled to one side of the case 21A by a rotation device 80A. At this time, because the rotation device 80A is positioned at an upper portion of the dust collection bin 20A, the cover 30A may rotate in a counterclockwise direction CCW on the upper portion of the case 21A.

After the cover 30A rotates and thus an opening 21A*a* of the case 21A opens, the dust collection bin 20A may separate foreign materials collected therein through a centrifugal rotation.

After dust and foreign materials are completely discharged, the cover 30A may return to the opening 21A*a* of the case 21A by a restoring force of the rotation device 80A. At this time, a sealing member 100A provided in the cover 30A may be applied an attraction force by a magnet 200A provided in the opening 21A*a* of the case 21A, and accordingly, the sealing member 100A may be deformed in shape to be tightly pressed against an inner wall of the case 21A, which improves a sealing force between the case 21A and the cover 30A.

Details about a structure and operation of the sealing member 100A for sealing between the dust collection bin 20A and the cover 30A applied to the cleaning apparatus 1A may be the same as those of the dust collection bin and the cleaning apparatus according to the above-described embodiment, and accordingly, overlapping descriptions will be omitted.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A dust collection bin detachably coupled to a cleaning apparatus, the dust collection bin comprising:

a case configured to accommodate dust or a foreign material sucked therein, the case including a first opening disposed on a bottom side of the case and a second opening disposed on a top side of the case, and a magnet provided around the first opening and configured to generate a magnetic force;

a cover configured to open or close the first opening; and a seal provided on the cover, configured to seal between the cover and the case, and being magnetic to be deformable by the magnet, wherein a portion of the seal deforms to move from a first position to a second position in response to the cover being closed, the second position being lower than the first position and higher than a lower end of the magnet, wherein the dust collection bin, when detached from the cleaning apparatus, is configured to be detachably couplable on a top of a docking station and to discharge the dust or foreign material through a center of the first opening, and wherein the dust collection bin is detachably coupled to the cleaning apparatus below a filter of the cleaning apparatus and receives the dust or foreign material through a center of the second opening, and the cover is exposed to an outside of the cleaning apparatus and openable while the dust collection bin is coupled below the filter of the cleaning apparatus.

2. The dust collection bin of claim 1, wherein the magnet is positioned at a location corresponding to the seal such that the seal applies a sealing force to the case in a closed state of the cover.

3. The dust collection bin of claim 1, wherein the seal includes a first material (rubber) which is at least one of nitrile-butadiene rubber (NBR), silicon rubber, thermoplastic polyurethane (TPU), or triethyl phosphate (TEP).

4. The dust collection bin of claim 3, wherein the seal includes a second material obtained by mixing the first material with iron or steel powder, by 10 weight percent (wt %) of the iron or steel powder to 80 wt % of the iron or steel powder, the iron or steel powder of a size of 1 micro meter (μm) to 100 μm.

5. The dust collection bin of claim 4, wherein the seal comprises:

a first sealing portion configured to cover the first opening; and a second sealing portion extending from the first sealing portion and being in contact with an inner wall of the case.

6. The dust collection bin of claim 5, wherein the second sealing portion includes a free end that is deformable in shape by the magnet.

7. The dust collection bin of claim 6, wherein at least one part of the free end is formed as a curved surface.

8. The dust collection bin of claim 5, wherein at least one part of the second sealing portion is formed as a curved surface.

9. The dust collection bin of claim 5, further comprising:

a rotation device configured to rotate the cover with respect to a main body, and the rotation device comprises:

a rotation shaft, and a torsion spring coupled to the rotation shaft, wherein one end of the torsion spring is connected with the cover and another end of the torsion spring is connected with the case.

10. The dust collection bin of claim 9, wherein upon returning of the cover from an open state by the rotation device, the first sealing portion of the seal covers the first opening, and wherein the second sealing portion is deformed in shape to contact the inner wall of the case and seals the case.

11. The dust collection bin of claim 1, wherein the magnet is positioned in a lower end of the case to generate an attraction force with respect to the seal.

12. The dust collection bin of claim 1, wherein the case further comprises a lock configured to lock or unlock the cover.

13. The dust collection bin of claim 12, wherein the lock further comprises a hook configured to fix the cover to the case and release locking of the cover by being pressed by an external force.

14. The dust collection bin of claim 12, wherein the lock is exposed to the outside of the cleaning apparatus and is operable to open the cover while the dust collection bin is coupled below the filter of the cleaning apparatus.

15. The dust collection bin of claim 1, wherein the case includes a slot provided around the first opening and configured to install the magnet.

16. The dust collection bin of claim 1, wherein the bottom side of the case is without an opening when the cover is closed.

17. A cleaning apparatus comprising:

a cleaner body including:

a suction portion configured to suck dust, an extension pipe connecting the cleaner body and the suction portion, and a dust collection bin detachably coupled below the cleaner body and above the extension pipe, the dust collection bin configured to:

receive air sucked through the suction portion through a second opening on a top of the dust collection bin, separate dust from air sucked through the suction portion, and store the dust, wherein the dust collection bin includes a case including a magnet configured to generate magnetism around a first opening on a bottom of the dust collection bin, a cover configured to open or close the first opening, and a sealing member configured to seal between the cover and the case and being magnetic to be deformable in shape by the magnet, wherein a portion of the sealing member deforms to move from a first position to a second position in response to the cover being closed, the second position being lower than the first position and higher than a lower end of the magnet, wherein the cover is exposed to an outside of the cleaning apparatus and openable while the dust collection bin is coupled below a filter of the cleaning apparatus, and wherein the dust collection bin is detachably coupled to the cleaning apparatus below the filter of the cleaning apparatus and receives the dust or foreign material through a center of the second opening.

* * * * *